United States Patent [19]

Abet et al.

[11] 4,359,925

[45] Nov. 23, 1982

[54] PROCESS FOR JOINING A SHELL WITH A CARTRIDGE CASE

[75] Inventors: Hans-Guenter Abet, Oss; Adrianus T. Maas, St. Oedenrode, both of Netherlands

[73] Assignee: NWM de Kruithoorn B.V., Poeldonkweg, 's-Hertogenbosch, Netherlands

[21] Appl. No.: 160,497

[22] Filed: Jun. 18, 1980

[30] Foreign Application Priority Data

Jun. 22, 1979 [DE] Fed. Rep. of Germany ..... 2925138

[51] Int. Cl.[3] ..... F42B 11/02

[52] U.S. Cl. ..... 86/43; 102/464; 102/465; 102/466; 102/467; 102/517

[58] Field of Search ..... 86/43; 102/464, 465, 102/466, 467, 517; 156/294

[56] References Cited

U.S. PATENT DOCUMENTS 3,369,426 2/1968 Matz ..... 156/294

3,968,750 7/1976 Deelen ..... 102/464

*Primary Examiner*—Paul R. Michl

[57] ABSTRACT

An improved process for joining a shell having a plastic base portion to a cartridge case within a joining region. The joining region extends along a plastic base portion of said shell when it is inserted into the neck portion of the casing and has an upper and lower limit. The base portion is being axially inserted into the neck portion of the casing while being subjected to a relative rotational movement. A glueing or synthetic substance having flow capability is introduced into the neck portion of the casing. This plastic or glueing substance after hardening adheres more strongly to the inner surface of the neck portion than on said plastic base portion. The process includes making a groove in the plastic base portion extending at least partially between said upper and lower limit; dosing a predetermined region of said neck portion; thereafter axially introducing the plastic base portion of the shell into the neck portion while imparting a relative rotation thereto; transporting at least a portion of said dose of glueing or synthetic substance due to translational and centrifugal forces into the groove; and letting the synthetic or glueing substance harden therein.

5 Claims, 3 Drawing Figures

PROCESS FOR JOINING A SHELL WITH A CARTRIDGE CASE

BACKGROUND OF THE INVENTION

Projectiles having a substantially non-deformable casing, for example, a casing made out of steel or being provided with a sabot made, for example, out of a light metal alloy, can be provided in the region of the connection between the shell and the casing with an annular groove extending around the projectile, in which the shell casing in the region of the openmouth is crimped, to thereby from a form-locking connection, which can only be overcome by a sufficiently strong predetermined expelling force. The rigid connection must be able to withstand high braking forces, particularly with ammunition for rapid-fire weapons, which appear as an impact shock during the introduction of the cartridges into the loading chamber.

In a projectile, which is formed in the region of its connection to the shell proper out of plastic material, the connection cannot be in the form of a crimp connection because of the problems which are inherent with the materials to be joined which have not the required strengths. Therefore, another type of method must be selected.

With break-up ammunition the described manual steps for producing a connection include the application of a glueing or synthetic liquid substance which hardens and which is applied by means of a brush to the inner surface of the throat of the cartridge case, whereafter a fragmentation shell, having a roughened plastic tail section, is pressed in. The following drawbacks are present in the ammunition of the state of the art:

In order to obtain a good connection which will withstand the application of a strong expelling force, the glueing or synthetic substance must be applied frequently in large amounts. This, in turn, causes considerable soiling, which in turn requires a post-cleaning step. This manual step is uneconomical because of the aimed for production intensity which requires numerous control conditions; this step can also become harmful to the personnel carrying out the manual step.

SUMMARY OF THE INVENTION

It is an object of this invention to provide a joint in a projectile of the afore-described type in which the afore-described drawbacks are avoided or mitigated. It is a further object of the invention to simplify the manufacturing process to thereby render it more economical insofar as production time and raw material requirements are concerned, as well as automizing the manufacturing process.

These objects of the invention are achieved by comparably simple means whereby within narrow limits reproducable results are achieved which provide for a continuous assembly-line production.

BRIEF DESCRIPTION OF THE DRAWING

The invention is further described in conjunction with the appended drawing in which.

DETAILED DESCRIPTION

Figure 1:
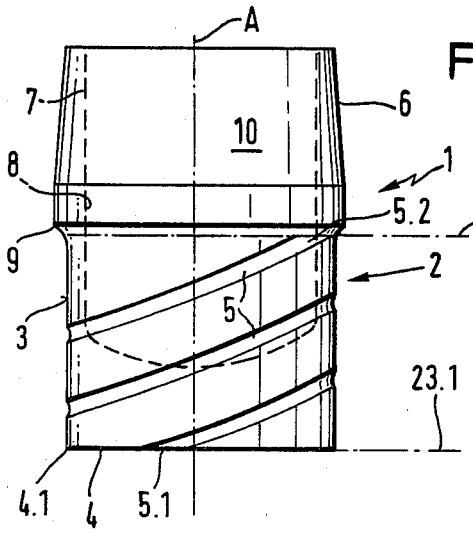
FIG. 1 illustrates schematically the plastic base portion of a break-up projectile shown in elevation.
Figure 2:
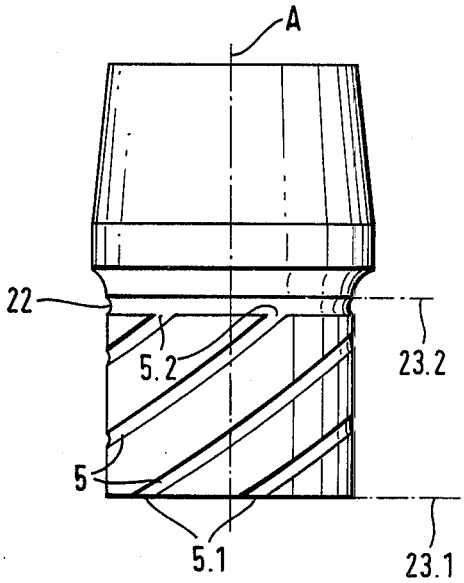
FIG. 2 is a second embodiment of the plastic base portion of a break-up projectile shown in elevation.

As illustrated in FIG. 1 a plastic base portion 1 of a shell has a tail section 2 including a cylindrical surface 3 and a bottom 4. There are worked in groove-like indentations 5 in the cylindrical surface 2, which extend along a helical line from a lower limit 23.1 to an upper limit 23.2 of a connecting region which is not further illustrated. A band 8 divides the tail section 2 from the forward portion 6 of the base portion 1, which forward portion 6 is provided with an inner space 10 defined by an inner surface 7. The band 8 has a rear edge 9 which adjoins according to the embodiment of FIG. 2, an annular groove 22 in the plastic base portion 1 at the upper limit 23.2 of the connecting region, into which the indentations 5 run in.

Figure 3:
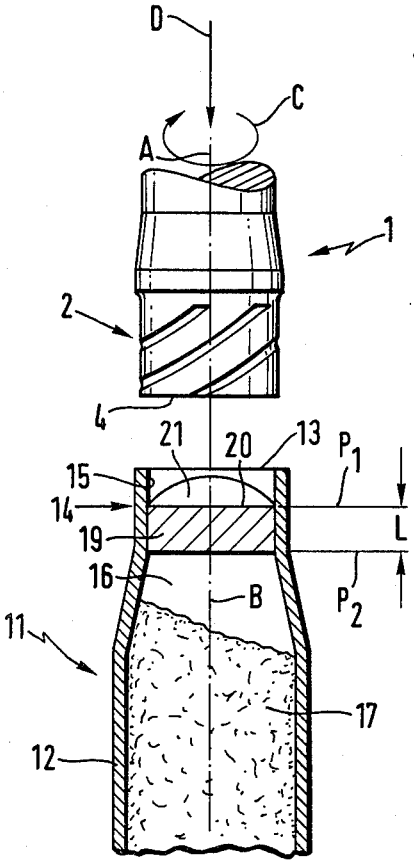
FIG. 3 is an elevational explosive view showing an arrangement in accordance with the process of the invention whereby two elements are being connection to each other, that is the plastic base portion of a shell shown in elevation and the cartridge case shown in elevational section.

In FIG. 3 there is illustrated a cartridge case 11 having a wall 12 which defines an inner chamber 16 having inner surfaces 15 and having a reduced diameter neck portion 14 having an open mouth 12. The inner chamber 16 is filled with Propellant charge powder 17. There is disposed within the neck portion 14, a cover element 19, for example, a felt plug. The cover element 19 is installed with its upper side 20 in an outgoing position $P_1$. The upper side 20 of the cover element 19 has a hardenable glueing or plastic substance 21 which has flowing properties.

For joining the plastic base portion 1 of the projectile with the cartridge case 11 the following method in accordance with the invention is used:

The plastic base portion 1 of the projectile is provided as illustrated in FIG. 1, with groove-like indentations 5, which have a beginning 5.1 in the border region of the bottom 4 of the lower limit 23.1 of the connecting region. The groove-like indentations extend along a helical line to the upper limit 23.2 of the connection region where they end at 5.2. The cover element 19 is inserted into the neck portion 14 of the cartridge-case 11 in which the propellant charge 17 is disposed in such a way that its upper side 20 assumes the initial position designated with the reference number $P_1$. The propellant charge casing 11 is mounted in a non-illustrated support. There is applied to the upper side 20 of the cover element 19 a predetermined amount of glueing or plastic substance 21 having flowing properties. Thereafter the plastic base portion 1 of the shell is positioned in such a way that the bottom 4 of the shell confronts the casing-mouth 13 and the longitudinal axis A of the shell coincides with the longitudinal axis B of the propellant charge casing 11. By means of a non-illustrated arrangement the shell is rotated in the direction of the arrow C about the total axis A and B by application of an axial force in the direction of the arrow D. As a result of these motions, the tail section 2 of the shell now seals with its bottom 4 the mouth 13 of the casing 11. In the region of 4.1 of the bottom 4 of the peripheral surface 3 the indentations or grooves form a number of passage ways. As the bottom 4 approaches the upper side 20 of the cover element 19 there escapes first of all the air captured therebetween through the inlets 5.1 of the grooves or indentations 5. The bottom 4 now comes into contact with the glueing or synthetic substance 21 which has flowing properties and, as a result of rotation, the substance 21 is urged against the inner surface 15. It arrives there in the region of the inlets 5.1 of the grooves or indentations 5 and is transported in the manner of a screw conveyor in the direction of the upper border 23.2 of the connecting region. The process is terminated as soon as the plastic base part 1 has been introduced to a predetermined depth into the casing neck portion 14. Thereby the cover element 19 after being pushed over in the distance L reaches with its upper side 20 a final position designated with the reference number $P_2$. A small amount of the glueing or synthetic substance 21, having flowing properties, is spread out above the mouth 13 and serves as proof that it has filled up a predetermined region between the inner surface 15 and the counter surface in the peripheral region of the plastic base part 1.

During hardening of the glueing or synthetic substance 21, there is brought about a strong adhesion of both corresponding surfaces. Thereby the glueing or synthetic substance 21 adheres after hardening more strongly to the inner surface 14 than to the opposite plastic surface of the base portion 1. In this manner when a sufficient expelling force has been applied a damaging expulsion or discharge of the hardened glue or synthetic substance 31 in the corresponding gun barrel is avoided.

When the tail section 2 is provided at the upper limit 23.2 of the joining region with an annular groove 22 into which the grooves or indentations 5 run in (see FIG. 2), then it is possible to collect in the annular groove 22 glueing or synthetic substances 21 which have flowing properties so as to harden therein and not exit from the grooves 5 and therefore advantageously not appearing outside of the casing mouth 13. Furthermore, an advantageous sealing effect is achieved for protecting the contents of the casing, respectively the inner surface 15 thereof. As a modification of the process illustrated in FIG. 3, the process in accordance with the invention can be carried out with rotating and axially moving a casing 11 as well as by means of simultaneously corresponding movements of the casing 11 and the shell.

Experiments have shown that other types of grooves and indentations 5 which deviate from those shown in the drawing, are suitable and achieve the desired result of moving and spreading the glueing or synthetic substance 21. For example, the grooves 5 can extend parallel to the axis A of the shell or may have increasing or decreasing angularity relative to the axis A of the shell and may also be of different depth along their lengths.

When the transporting grooves designated as indentations or grooves 5 have sufficient depth and extend helically there is effected, after the hardening of the glueing or synthetic substance 21, a form-locking connection between the cartridge case 11 and the plastic base portion 1 in an axial direction. It is desirable that the glueing or synthetic substance 21 after hardening preferably has a higher stability than the plastic material of the corresponding shell base portion 1 in the joining region, so that with a sufficient required expelling force no hardened glueing or plastic substance 21 is expelled from the mouth 13 of the neck portion 14. A form-locking connection in the axial as well as in the peripheral direction is achieved with a sufficiently deep cross-sectional profile of the indentations or grooves 5 having a winding course with increasing or decreasing angularity, or when, the indentations or grooves 5 extend parallelly, thereby at least in one region the depth of the side facing the upper limit 23.2 is larger than the side facing the lower limit 23.1 of the joining region. The afore-described transporting effect is also then achieved with a suitable viscosity of the glueing or synthetic substance 21, when the indentations or grooves 5 have very flat profiles, that is a very shallow depth. Of course, in such a case there is obtained in lieu of a form-locking connection a substantial frictional connection of the corresponding surfaces. A form-locking as well as frictional connection can also be obtained when, with sufficient depth of the transporting grooves or indentations 5, the surface 3 between the grooves 5 have at least partially a small play with respect to the inner surface 15. The glueing or plastic substance is then distributed in such a way in the entire region between the lower limit 23.1 and the mouth of the casing 13 or the annular groove 22 at the upper limit 23.2 of the joining region, that advantageously an additional sealing effect is obtained. The last-described effect provides protection with respect to the propellant charge powder 17 as well as with respect to the inner surface 15 when extreme atmospheric conditions prevail over long periods of time, for example during storage of the ammunition.

It will become evident from the foregoing description of the process of the invention that the transportation effect is enhanced when the cover element 19 with its upper side 20 is slideable movably mounted from a starting position $P_1$ near the mouth 13 of the casing 11 to a deeper final position $P_2$. The bottom 4 is then placed in contact sooner with the glueing or plastic substance 21 having flow capability, so that with the illustrated arrangement there is achieved an additional expelling effect, which improves the transportation effect.

In accordance with a non-illustrated embodiment the bottom 4 can be funnel-shaped, so that it is suitable to accept a dosed amount of the synthetic substance having flow capability. If the projectile is oriented with its bottom 4 upwardly and is introduced under rotation into the upwardly arranged cartridge case 11, then the afore-described centrifugal and transportation effect is achieved. The cover element 19 prevents a falling out of the propellant charge 17 from the mouth 13 of the casing. If it becomes necessary the propellant charge 17 can also be introduced via an opening for a non-illustrated ignition screw after a joining of the casing with the shell has been effected.

There has been described hereinabove a process in accordance with the invention in connection with one embodiment relating to break-up ammunition. As can be noted from the description, the invention can also obviously be utilized for other shell-casing joining wherein in the joining region at least one surface belongs to a non-metallic element.

Although the inventive process is illustrated and described with reference to several preferred embodiments thereof, it is to be expressly understood that it is in no way limited to the disclosure of such preferred embodiments, but is capable of numerous modifications within the scope of the appended claims.

What we claim is:

1. An improvement in a process for joining a shell having a plastic base portion to a cartridge casing within a joining region which extends in an axial direction between an upper and lower limit of a neck portion of said casing when defined between an inner surface of said neck portion and a confronting cylindrical surface of said plastic base portion; whereby a glueing or synthetic substance having flow capability is introduced into said joining region where it hardens and adheres more strongly to said inner surface of said neck portion of said casing than on said confronting cylindrical surface of said plastic base portion, comprising the steps of (a) producing at least one groove extending along at least a portion of said confronting cylindrical surface of said plastic base portion between the upper and lower limit of said joining region;

(b) dispensing a dose of said glueing or synthetic substance into a predetermined region of said neck portion;

(c) axially introducing said plastic base portion of said shell into said neck portion of said casing to a predetermined depth while rotating said shell relative to said casing;

(d) transporting at least a portion of said dose of glueing or synthetic substance by means of the transportation effect achieved as a result of the centrifugal and translational forces into said at least one groove in said joining region from said lower limit towards said upper limit; and (e) letting said synthetic or glueing substance having flow capability harden in said joining region.

2. The improvement in the process for joining a shell having a plastic base portion to a cartridge casing, the steps as set forth in claim 1, wherein the region of the upper limit of said joining region there is provided an annular groove of predetermined cross-section on said plastic base portion, said at least one groove running into said annular groove.

3. The improvement in the process for joining a shell having a plastic base portion to a cartridge casing, the steps as set forth in claim 1, wherein said casing includes a cover element mounted in the neck portion thereof between the upper surface of said propellant charge in said casing and the mouth of said casing, said dose of glueing or synthetic substance being dispensed on said cover element.

4. The improvement in the process for joining a shell having a plastic base portion to a cartridge casing, the steps as set forth in claim 3, wherein said cover element is slidably mounted in said neck portion.

5. The improvement in the process for joining a shell having a plastic base portion to a cartridge casing, the steps as set forth in claim 2, wherein said at least one groove is helically shaped.

* * * * *